US008418383B2

(12) United States Patent
Badawi

(10) Patent No.: US 8,418,383 B2
(45) Date of Patent: Apr. 16, 2013

(54) CANVAS FRAME AND KIT FOR THE CONSTRUCTION OF A CUSTOM CANVAS FRAME

(76) Inventor: Mazin Badawi, Falls Church, VA (US)

( * ) Notice: Subject to any disclaimer, the term of this patent is extended or adjusted under 35 U.S.C. 154(b) by 30 days.

(21) Appl. No.: 13/043,792

(22) Filed: Mar. 9, 2011

(65) Prior Publication Data

US 2012/0227911 A1 Sep. 13, 2012

(51) Int. Cl.
*D06C 3/08* (2006.01)

(52) U.S. Cl.
USPC ..... 38/102.3; 160/377

(58) Field of Classification Search ..... 160/374, 160/374.1, 377, 379; 38/102.3, 102.4, 102.5, 38/102.6, 102.8, 102.9, 102.91; 403/335, 403/375, 355, 363, 364
See application file for complete search history.

(56) References Cited

U.S. PATENT DOCUMENTS

| | | | | | |
|---|---|---|---|---|---|
| 132,177 | A | * | 10/1872 | Prindle | 38/102.4 |
| 974,600 | A | * | 11/1910 | Robinson | 38/102.8 |
| 1,229,112 | A | * | 6/1917 | Mason | 38/102.5 |
| 1,353,242 | A | * | 9/1920 | Jacobsson | 160/374.1 |
| 1,737,983 | A | * | 12/1929 | Stott | 28/152 |
| 2,433,307 | A | * | 12/1947 | Thomas | 28/152 |
| 3,137,088 | A | * | 6/1964 | Spertus | 160/378 |
| 3,355,196 | A | * | 11/1967 | Harrison | 403/265 |
| 3,830,278 | A | * | 8/1974 | Packer | 160/378 |
| 4,179,830 | A | * | 12/1979 | Lamb | 38/102.5 |
| 4,190,974 | A | | 3/1980 | Siler | |
| 4,301,853 | A | | 11/1981 | Vidal | |
| 4,361,180 | A | * | 11/1982 | Stuvecke | 160/377 |
| 4,549,596 | A | * | 10/1985 | Staro | 160/374.1 |
| 4,720,406 | A | | 1/1988 | Dixon | |
| 5,115,584 | A | | 5/1992 | Lucchetti | |
| 5,900,276 | A | | 5/1999 | Sooklaris | |
| 6,253,471 | B1 | * | 7/2001 | Strauh | 38/102.1 |
| 6,520,240 | B2 | | 2/2003 | Sooklaris | |
| 7,077,147 | B2 | | 7/2006 | Louie et al. | |
| 7,293,378 | B2 | | 11/2007 | Bihr | |
| 7,469,493 | B2 | | 12/2008 | Pacovsky | |
| 7,698,840 | B2 | | 4/2010 | Rutkowski | |

* cited by examiner

*Primary Examiner* — David Purol
(74) *Attorney, Agent, or Firm* — Da Vinci's Notebook, LLC

(57) ABSTRACT

A canvas frame and canvas frame kit is disclosed that permits canvas frames of unorthodox configuration. The canvas frames include divergent interior portions that permit an irregular primary frame to be matched with a supplemental frame to present a single, unified work of art separable at the whim of the user.

19 Claims, 10 Drawing Sheets

CANVAS FRAME AND KIT FOR THE CONSTRUCTION OF A CUSTOM CANVAS FRAME

FIELD OF THE INVENTION

The present invention relates to the field of artistry and more specifically to the field of canvas design and construction.

BACKGROUND

Canvas frames tend to be predictable. They may be a large rectangle or a small rectangle. Canvas frames have rarely been used to create feeling; instead an artist relies almost wholly upon the drawing surface upon the canvas to convey artistry. To the extent that artistry extends beyond the drawing surface, it generally extends only to a picture frame supporting the canvas frame. There is a need for a means of constructing unorthodox canvas frames, unorthodox canvas frames, and cooperative canvas frames.

SUMMARY

The present invention is directed to means for generating, providing, and using irregularly and custom shaped art canvases. A first embodiment of the present invention includes a canvas frame construction kit with frame units and connector units. The frame unit is a building block of the canvas frame from which a user may construct a canvas frame in desired shapes. The frame unit includes a separated housing bilayer with a separator sandwiched within. The bilayer includes parallel, substantially planar elongate bodies. The interior separator is positioned centrally and flush against a periphery of the bilayer. The separator is sized to leave space on its sides and latitudinally, the minor apertures and major apertures, respectively. The elongate connector unit connects the frame units one to the other, such that any number of frame units may be utilized. The connector unit is sized to form a substantially flush peripheral configuration with the housing bilayer when positioned against the separator unit Another embodiment of the present invention includes a canvas frame construction kit with a primary canvas, supplementary canvas, and a flexible primary drawing surface. The primary canvas frame is irregular, that is to say it is not a rectangularly shaped canvas adapted to present a solid drawing core. The primary canvas includes a continuous periphery with more than four exterior side surfaces, and at least two of the side surfaces form a canvas aperture. A supplementary canvas frame is provided and is dimensioned to form a close fit relationship with the canvas aperture. The supplementary and primary canvas frame together form a combined frame that is substantially regular. The kit further includes a flexible primary drawing surface configured to provide a continuous drawing surface within the body of the primary frame. A continuous drawing surface is a drawing surface that presents to a viewer of a canvas a drawing surface lacking voids caused by the folding of the drawing surface about the frame.

Typically in the art such voids are not present as regular frames generally obviate their existence; however, with the present invention's introduction of irregular frames, the present invention further includes means of providing the continuous drawing surface. Preferred means includes the use of the flexible primary drawing surface, substantially identical in shape to the primary canvas frame. The drawing surface includes surface excess dimensioned to wrap about the primary canvas frame canvas periphery, and the surface excess includes excess buttresses. The excess buttresses are preferable contiguous, and correspond to the apertures formed by the primary canvas aperture. The excess buttresses are dimensioned to be overlapping and present a continuous drawing surface upon wrapping the excess about the primary canvas periphery.

The canvas aperture need not be positioned upon the exterior of the canvas frame. In another embodiment of the present invention, the canvas frame construction kit includes a primary canvas frame, a central frame projection, and a central canvas support. The primary canvas frame includes a canvas periphery having exterior side surfaces. The central frame projection connects to and extends from the exterior side surfaces to be positioned within the exterior side surfaces. The central canvas support is connected to the central frame projection to form a central canvas aperture. The kit may include a supplementary canvas frame dimensioned to be positioned within the canvas aperture in a close fit relationship.

Another embodiment of the present invention includes an interfit canvas frame with a primary canvas, supplementary canvas, and a flexible primary drawing surface. The primary canvas includes a periphery with more than four exterior side surfaces, and at least two of the side surfaces form a primary canvas aperture and primary canvas protrusion. A supplementary canvas frame is provided with at least two side surfaces dimensioned to form a supplementary canvas protrusion and supplementary canvas void, each adapted close fit relationship with the primary canvas aperture and primary canvas void, respectively. The supplementary and primary canvas frame may fit together to form a combined frame that is substantially regular. It is preferred that the supplementary canvas frame and primary canvas frame are substantially equal in size.

Therefore, it is an aspect of the present invention to provide a frame capable of varying shapes and sizes.

Therefore, it is an aspect of the present invention to provide a frame capable of modifiable shapes and sizes.

Therefore, it is an aspect of the present invention to provide multiple complementary frames and drawing surfaces.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
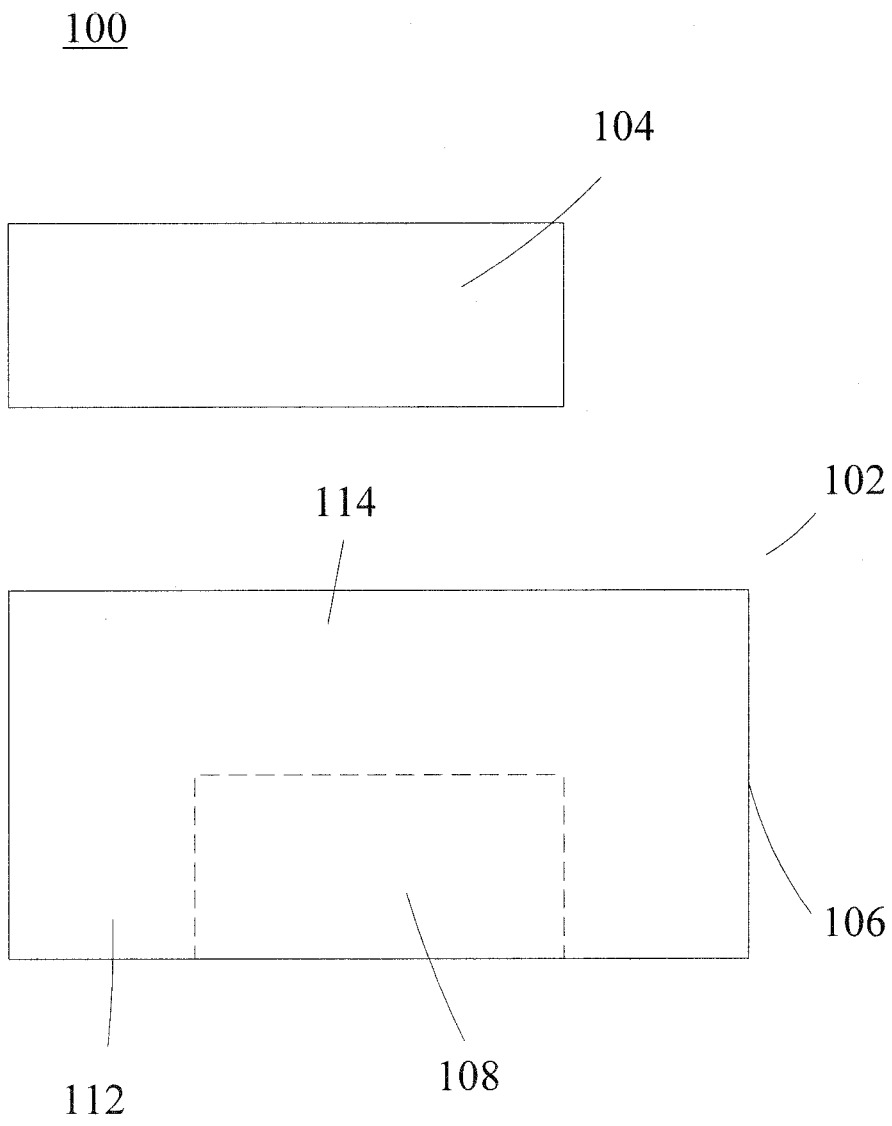
FIG. 1 is an orthographic view of the kit of the present invention.
Figure 2:
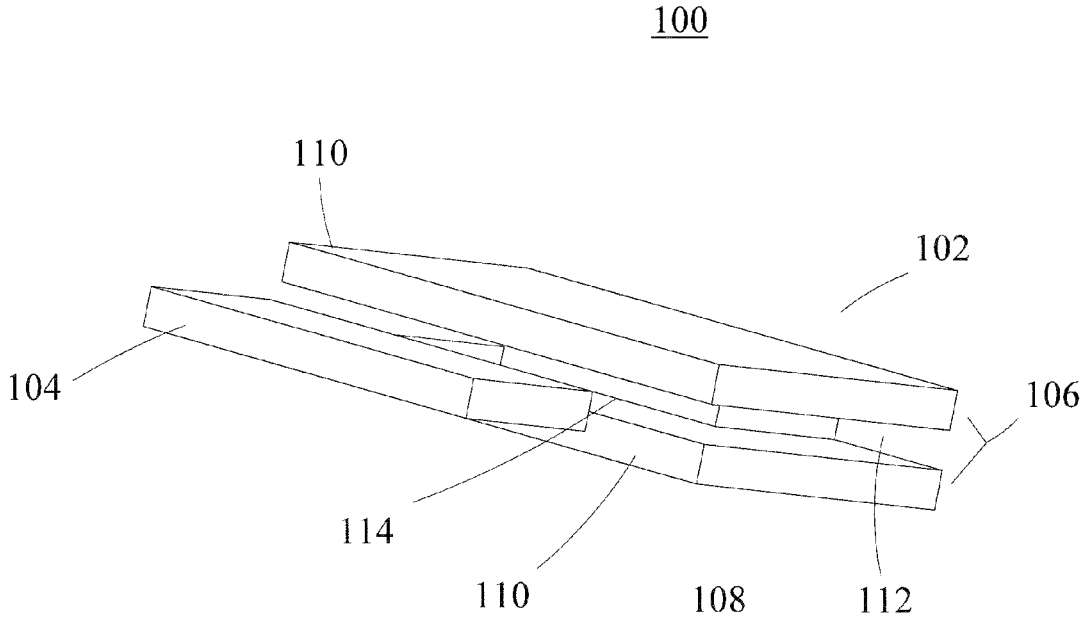
FIG. 2 is a perspective view of the kit of the present invention.

Referring first to FIGS. 1 and 2, a basic embodiment of the canvas frame construction kit 100 is shown. The kit 100 includes frame units 102 and connector units 104. The frame unit includes a separated housing bilayer 106 with a separator 108 sandwiched within. The bilayer 106 includes parallel, substantially planar elongate housing units 110. The housing units 110 are substantially planar entities that are positioned parallel to each other. By substantially planar, it is meant that the dimensional attributes of the housing units 110 are such that they are essentially flat with a girth suitable for support of the kit as a frame.

Sandwiched within the housing units 110 is the separator 108. It is preferred that the separator is wholly engulfed by the housing units 110. That is to say that the separator 108 is constructed, and positioned with the housing bilayer, such that no portion of the separator extends beyond the bounds of the housing units. It is preferred that the separator and the housing bilayer share a common peripheral edge such that the housing bilayer and separator form a flush relationship. The separator preferably includes a width half of the width of the housing bilayer. The preferred length of the separator is such that when centrally and peripherally positioned in the housing bilayer to create two flanking minor apertures 112 formed with the width of the separator. Thus, the value of the width of the separator is the distance from the longitudinal extremities of the separator to the nearest edge of the housing bilayer, and similarly, the distance from the latitudinal extremities of the separator to the nearest edge of the housing bilayer. Exemplary dimensions of the separator include a length of 2.0 inches, a width of 1.0 inch, and a girth of 0.25 inches. Exemplary dimensions of the housing units include a length of 4.0 inches, a width of 2.0 inches, and a girth of 0.25 inches. A major aperture 114 is present within the housing bilayer along the latitudinal surface of the separator and points beyond. Materials suitable for the construction of the frame unit include wood, plastic, and other materials capable of supporting a drawing surface and accepting fastening means for the drawing surface.

Figure 3:
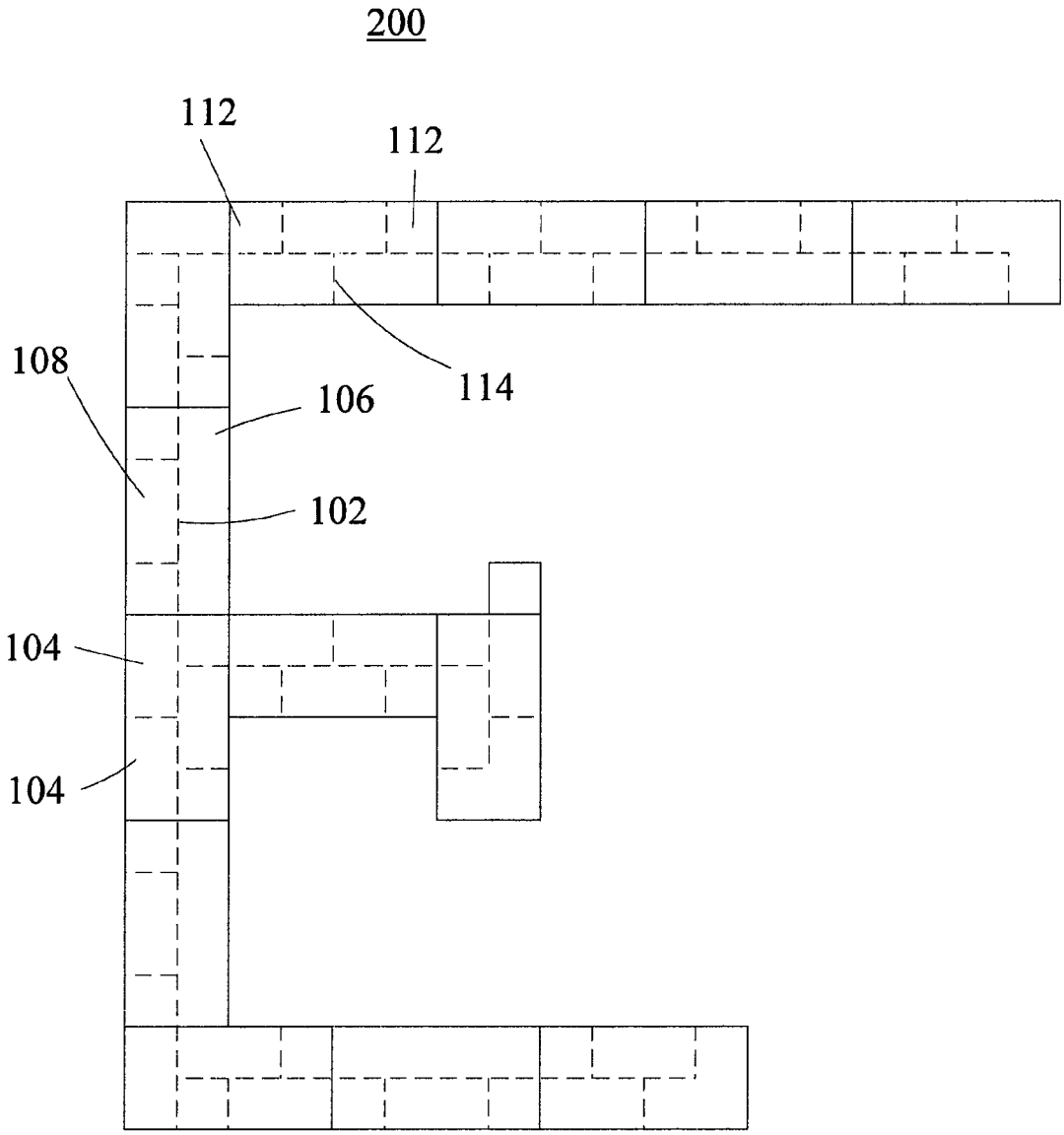
FIG. 3 is an exposed orthographic view of the frame of the present invention.
Figure 4:
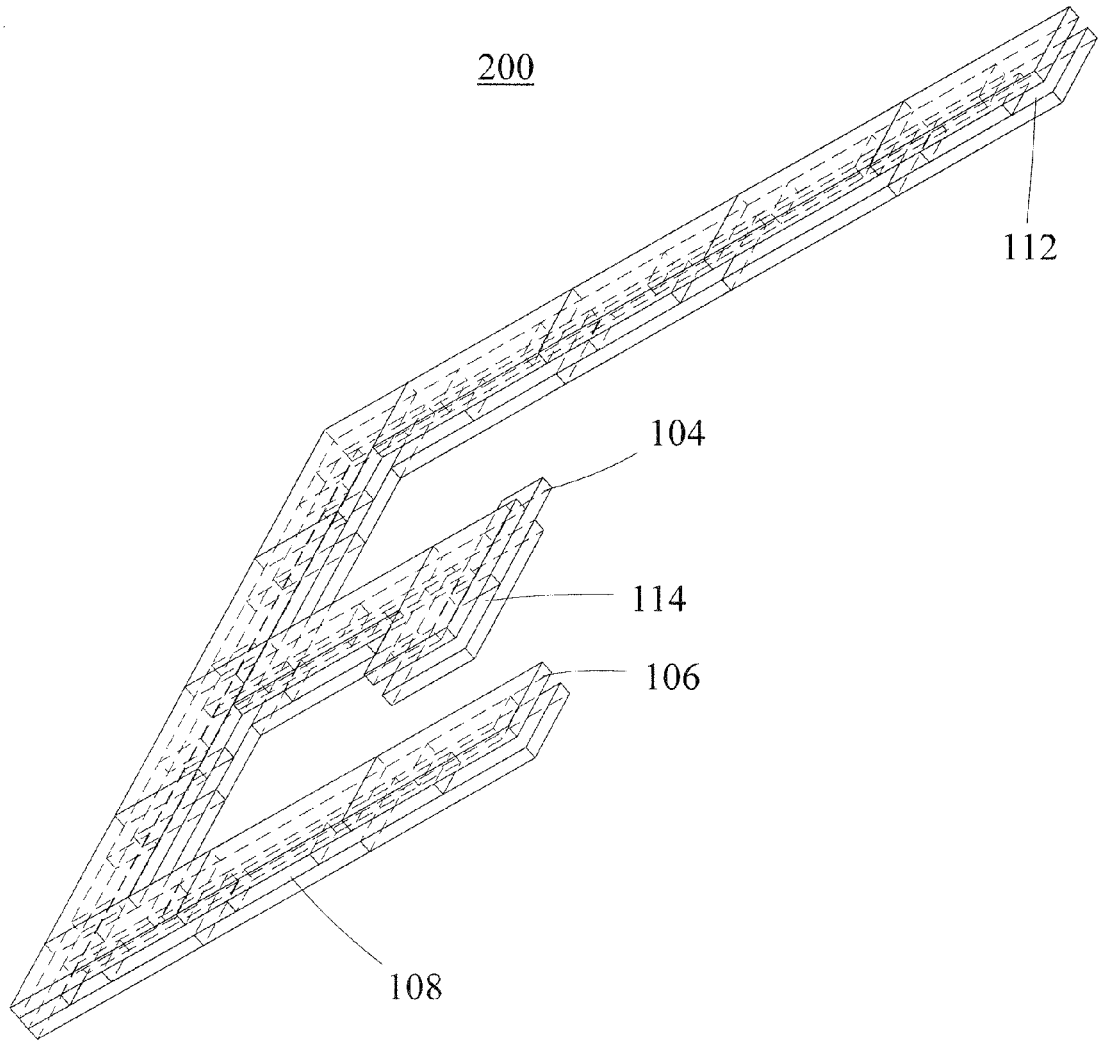
FIG. 4 is an exposed perspective view of the frame of the present invention.
Figure 5:
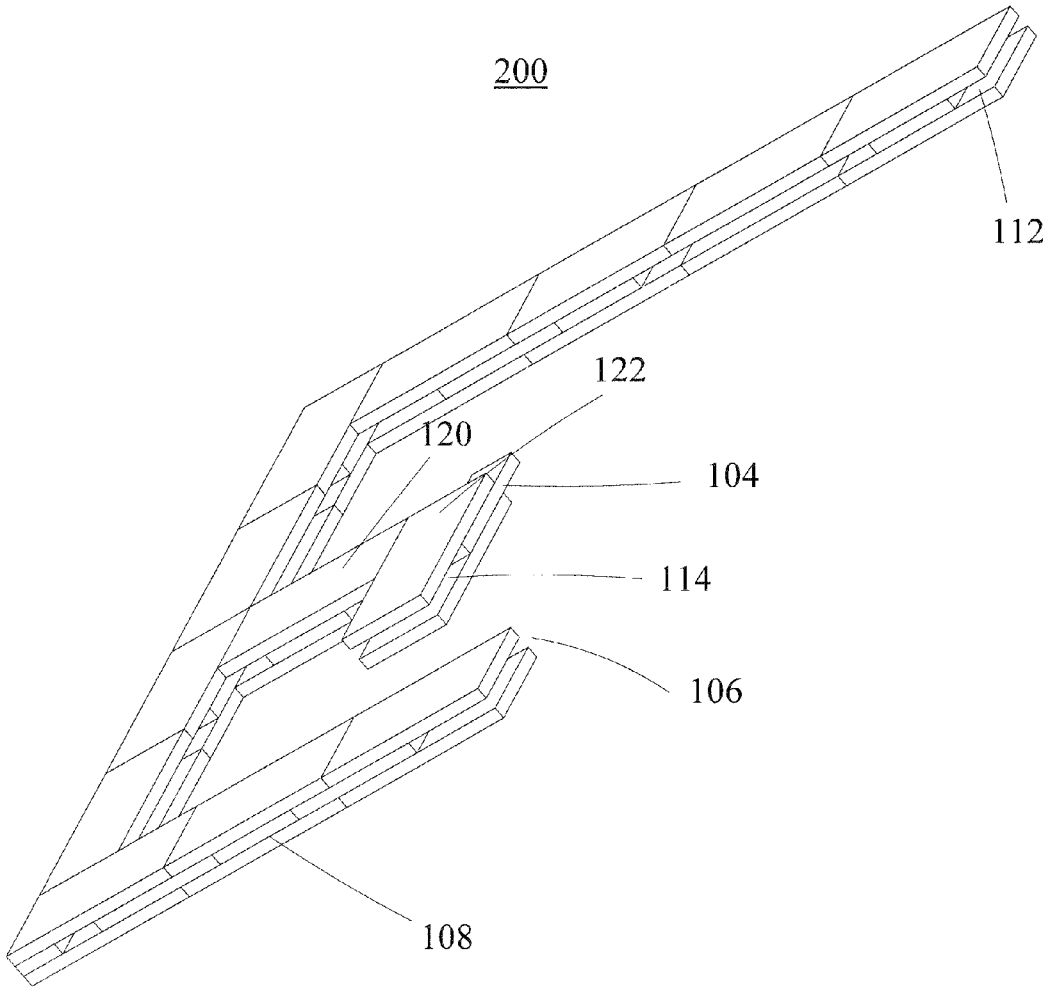
FIG. 5 is a perspective view of the frame of the present invention.

The elongate connector unit 104 connects the frame units 102 one to the other, such that any number of frame units may be utilized in the construction of a frame. The connector unit is preferably sized to include the girth of the separator, or slightly greater to form an interference fit, a width equal to that of the separator, and a length of approximately three times the width of the separator. Preferred dimensions are: width, 1.0 inch; girth, 0.25 inches; length, 3.0 inches. As shown in FIGS. 3-5, the connector unit 104 includes a width such that placement against the separator, either longitudinally or parallel thereto, will form a flush configuration with the exterior periphery of the housing bilayer. The connector unit 104 further includes a length, when longitudinally positioned with the separator 108, that will permit the connector unit to occupy the entirety of the minor aperture 112 and approximately half of the major aperture 114. Thus the axial position of the frame unit 102 may be alternated unit-to-unit to form a substantially solid outer periphery. Furthermore, the connector units 104 may be used to form a central projection 120 which leads to a central canvas support 122. The aggregation of the connected frame units forms the canvas 200. The canvas 200, which includes the kit 100, of the present invention may be constructed to include unorthodox shapes, sizes, and features.

Turning now to FIGS. 6-9, the canvas 200 of the present invention may include a primary canvas 300 and a supplementary canvas 304 with a primary drawing surface 400 and supplementary drawing surface 402, respectively. The preferred drawing surface is a flexible sheet of drawing medium, such as paper, capable of accepting expression and affixation to a canvas. The primary canvas 300 of the present invention may be irregular, that is to say, not a rectangularly shaped canvas that also accepts only a solid drawing core. By solid drawing core, it is meant a drawing surface upon a canvas that is wholly continuous within the corners of the canvas. The preferred canvas is an irregular canvas forming an interior aperture 302. An interior aperture 302 is a void that extends within the periphery of the canvas, and may include a canvas configured to position a void wholly within the bounds of the canvas as in FIG. 6, or a canvas configured to position a void at least partially within the bounds of the canvas such that the void is not wholly engulfed by canvas as in FIG. 8. The interior aperture possesses bounds formed by a divergent canvas portion 122. The divergent canvas portion 122 is the portion of the canvas that results in the inwardly formed interior aperture. The divergent canvas portion 122 accepts the drawing surface 400.

Figure 6:
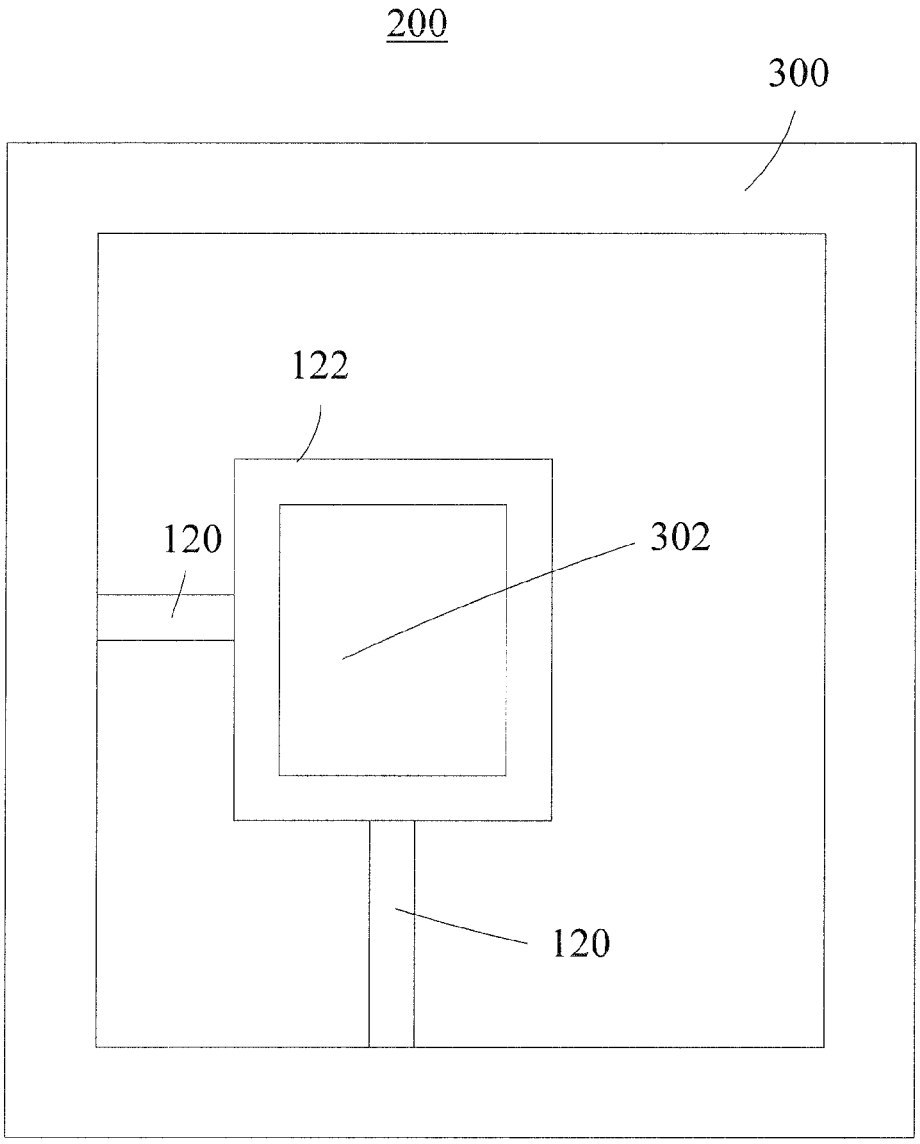
FIG. 6 is an orthographic view of the frame of the present invention.
Figure 7:
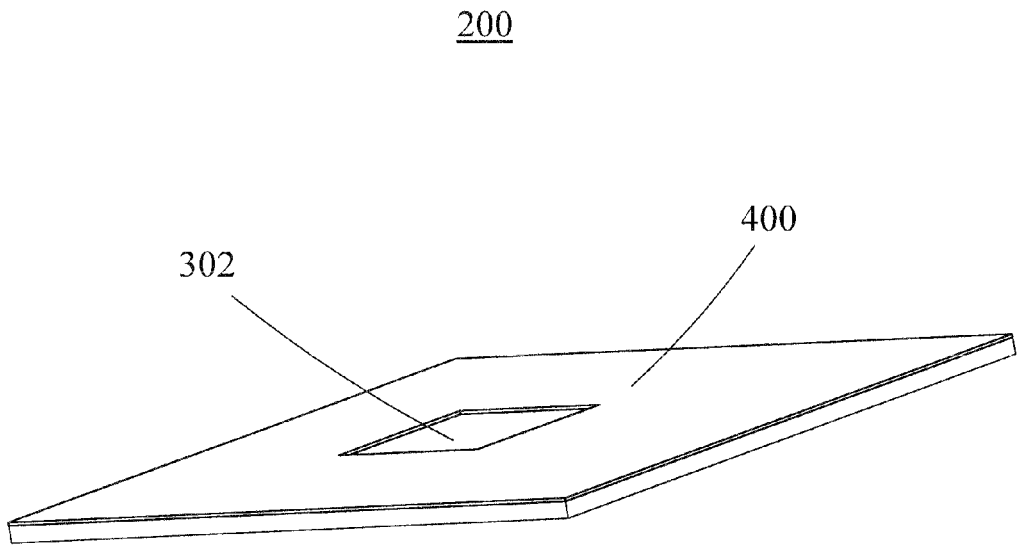
FIG. 7 is a perspective view of the frame of the present invention.

FIGS. 6-7 depict a central aperture canvas frame embodiment 200 of the present invention. The canvas frame 200 includes the primary canvas frame 300 with a central frame projection 120 extending inwardly. The central frame projection 120 is bridge between the primary canvas frame 300 and the divergent canvas portion 122, in the present embodiment referred to as a central canvas support. The central canvas support is a frame within the primary canvas frame 300 that permits a primary drawing surface 400 to wrap thereon. It is preferred that the primary drawing surface 400 include a shape substantially identical to that of the primary canvas with surface omitted to accommodate the shape of the primary canvas less the central canvas support, and further includes such excess material as is sufficient to permit the primary drawing surface to fasten to the canvas frame 200. One or more central frame projections may be utilized, and the frame projections may include recesses to accommodate the user's tastes as to interference caused by the central projection. For example, the central frame projection may be recessed in its entirety from the primary canvas frame interior to the central canvas support exterior to prevent strokes of a drawing implement from contacting the central frame projection.

Figure 8:
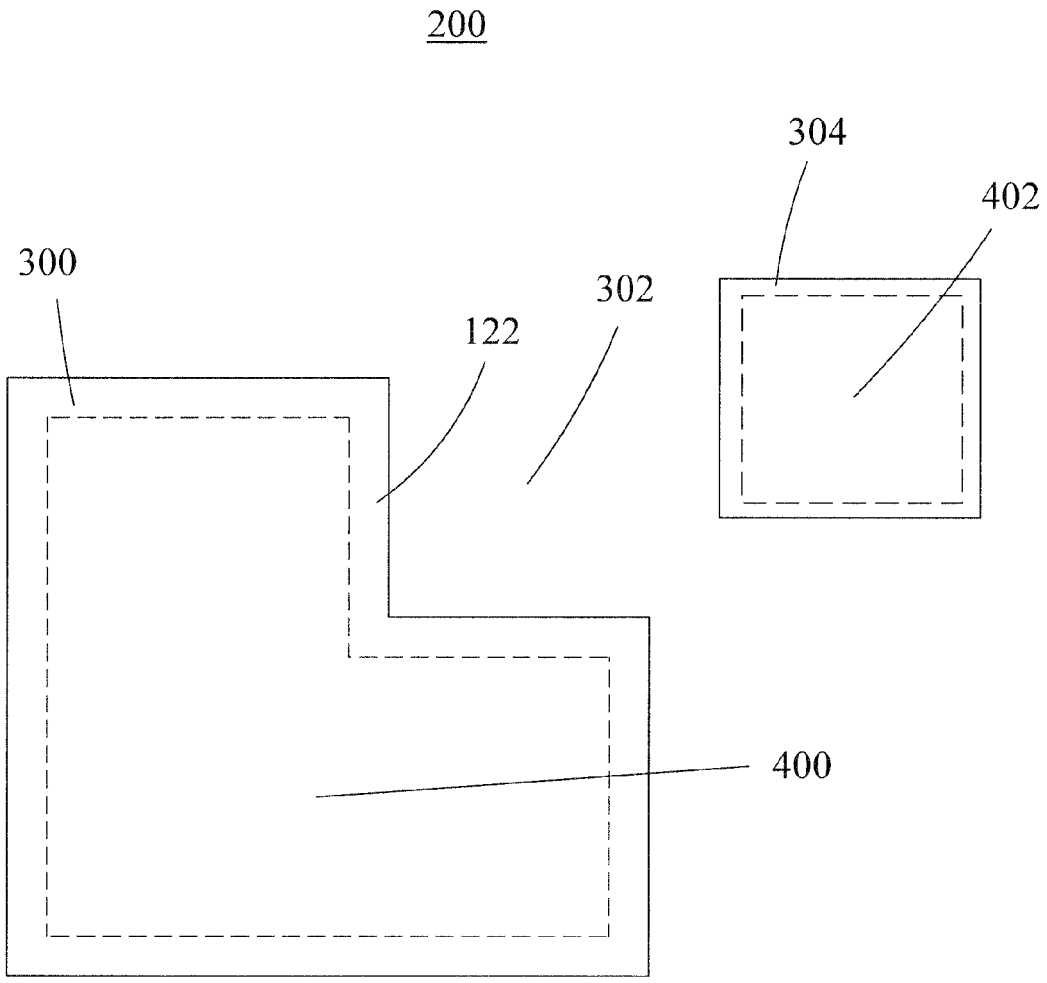
FIG. 8 is an exposed orthographic view of the frame of the present invention.
Figure 9:
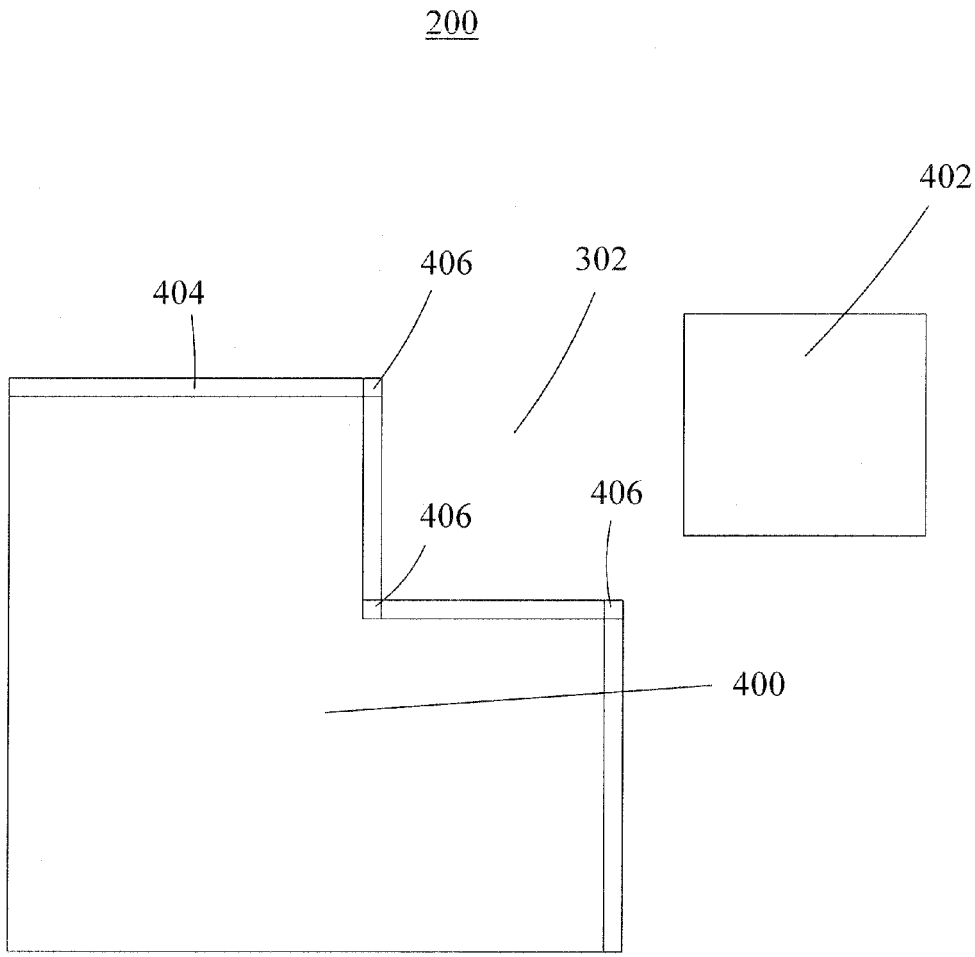
FIG. 9 is an orthographic view of the frame of the present invention.

Turning now to FIGS. 8-9 a peripheral aperture canvas frame 200 is shown. The peripheral aperture canvas frame 200 includes an irregular canvas frame with a continuous periphery with at least five exterior side surfaces. At least two of the side surfaces will form a divergent canvas portion that forms an interior aperture that is exposed on at least one side. The version of the canvas frame 200 in FIGS. 8-9 depict an interior aperture bounded by two frame side surfaces, and exposed on two aperture sides. The interior aperture of the present invention does not have a physical side, but is instead merely a represents the natural location of the non-divergent primary frame side surfaces had they been continued absent the interior divergence. The primary canvas frame 300 includes the divergent canvas portion 122, in the present embodiment referred to as a peripheral canvas support.

The peripheral canvas support accepts the primary drawing surface 400. As the present invention utilizes unorthodox canvas frame shapes, it is feature of the present invention to utilize a primary drawing surface 400 with excess buttresses 406. Canvas paper naturally includes excess 404 to permit the paper to wrap about the exterior side surfaces of a canvas frame. However, canvas paper is principally adapted only to wrap about regular canvas shapes. The use of ordinary canvas paper achieves a drawing surface on the canvas with non-contiguous drawing surfaces. In other words, when the canvas paper is folded about the frame, gaps will appear at the edges of the excess 404 along the serrations positioned to permit folding. The excess buttresses 406 of the present invention includes additions to the drawing surface 400 that permit a drawing surface having a surface area greater than that which would normally be present for the planar representation of that particular shape. In other words, the excess of the drawing paper that corresponds to one canvas frame side surface will overlap with the adjoining excess that corresponds to the adjoining canvas frame side surface. The use of an excess buttress in particularly convenient on interior angles of the divergent canvas portions 122. The excess buttresses may be fabricated by press fitting or other means of pulp compression.

The present invention further includes the use of combined canvas frame that is the close fit aggregation of the primary canvas frame 300 and a supplementary canvas frame 304. When used in the present disclosure in discussion of the primary canvas frame and a supplemental canvas frame, the primary canvas frame is meant to include the most exterior portion and all frame portions connected thereto, including the central frame projection and the central frame support. The supplementary canvas frame 304 is a canvas frame having dimensions substantially similar to the interior aperture 302 such that combination of the supplementary canvas frame 304 with the divergent frame portion 122 of the primary canvas 300 occupies the entirety of the interior aperture 302 and provides the "sides" of the interior aperture. The preferred combined frame forms a regular frame; which is not to say that the combined frame requires the physical combination described above, instead the possibility of such combination is the basis of the present invention. The supplemental canvas frame 304 supports a supplemental drawing surface 402. It is preferred that the supplemental drawing surface 402 and the primary drawing surface 400 include a unified work of art that upon combination of the primary canvas frame 300 and the supplemental canvas frame 304 presents a single work of expression.

The peripheral aperture canvas frame embodiment and the central aperture canvas frame embodiment may be constructed with the frame units of the present invention, or otherwise constructed of more conventional methods of frame construction.

Figure 10:
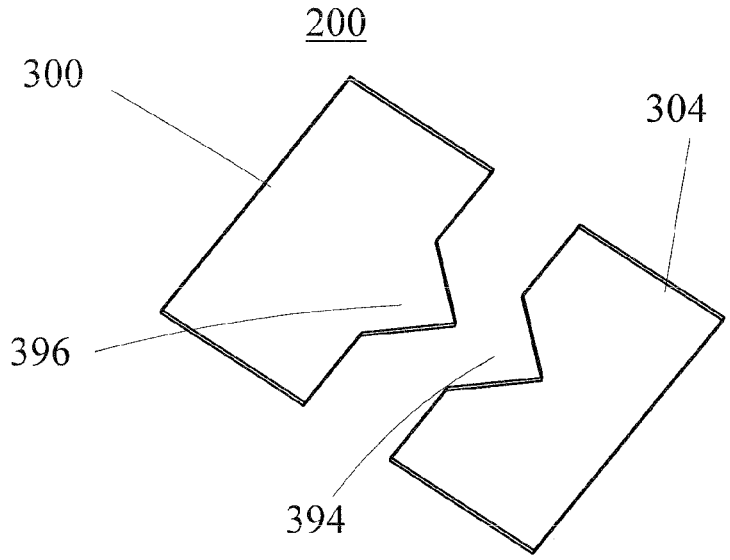
FIG. 10 is a perspective view of the frame of the present invention.
Figure 11:
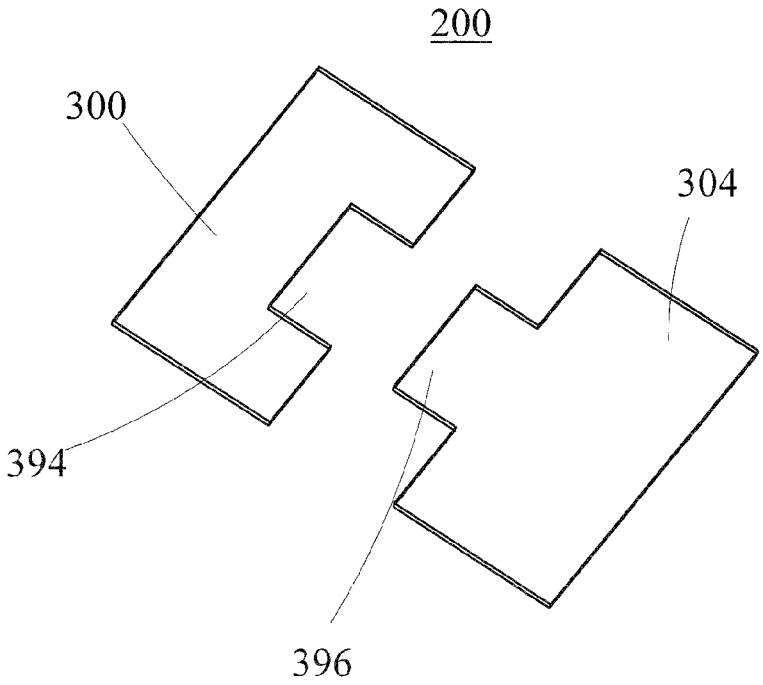
FIG. 11 is a perspective view of the frame of the present invention.

Turning now to FIGS. 10-11, an interfit embodiment of the canvas 200 of the present invention is depicted. The interfit embodiment includes the primary canvas 300 and supplementary canvas 304 that form complementing components of a rectangular, or other shape, canvas. The primary canvas 300 includes a periphery with more than four exterior side surfaces, and at least two of the side surfaces form a primary canvas aperture 394 and primary canvas protrusion 396. A supplementary canvas includes a periphery with more than four exterior side surfaces and includes at least two side surfaces dimensioned to form a supplementary canvas protrusion 386 and supplementary canvas void 394, each adapted for close fit relationship with the primary canvas aperture 394 and primary canvas protrusion 396, respectively. The interfit canvas differs from other embodiments in that each component, i.e. primary canvas and supplementary canvas(es), will include both an aperture and protrusion—contrasted, for example with the embodiment of FIG. 8, which includes only a single discernable aperture in the primary canvas and the whole of the supplementary canvas is ostensibly a protrusion for fit within the aperture. The preferred supplementary and primary canvas frame together form a combined frame that is substantially regular. It is preferred that the supplementary canvas frame and primary canvas frame are substantially equal in size. Furthermore, any number of interfit canvas frame components may be utilized, preferably with the aggregate forming a regular canvas.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A canvas frame construction kit, said kit comprising:

multiple frame units, each of said frame units comprising:

a separated housing bilayer with parallel, substantially planar, elongate housing units;

a substantially planar separator unit, wholly engulfed within said housing bilayer and positioned peripherally thereto, defining a major aperture within said frame unit opposite said separator unit and multiple minor apertures within said frame unit flanking said separator unit;

and multiple elongate connector units, each of said connector units dimensioned to form a substantially peripherally flush configuration, upon contact placement upon said separator unit, with said housing bilayer upon longitudinal insertion within said major aperture.

2. The kit of claim 1 wherein said multiple elongate connector unit is dimensioned to form a substantially peripherally flush configuration, upon contact placement directly longitudinal to said separator unit, with said housing bilayer and said separator unit upon longitudinal insertion within said minor aperture.

3. The kit of claim 2 wherein said multiple elongate connect unit is dimensioned to form a substantially centrally flush configuration, upon contact placement directly longitudinal to said separator unit, with said separator unit upon longitudinal insertion within said minor aperture.

4. The kit of claim 3 wherein said multiple elongate member is dimensioned to form a substantially flush configuration, upon contact placement directly latitudinal to said separator unit within said minor aperture, with said housing bilayer and project a latitudinal elongate member projection.

5. The kit of claim 4 wherein said latitudinal elongate member projection is dimensioned to form a close fit relationship with an adjoining separator of an adjoining perpendicular frame unit upon direct longitudinal placement with said adjoining separator.

6. The kit of claim 5 wherein said latitudinal elongate member projection is dimensioned to form a flush relationship with said adjoining separator of said adjoining perpendicular frame unit upon direct longitudinal placement with said adjoining separator.

7. The kit of claim 6 comprising multiple frame units united to include an irregular primary canvas frame with at least five exterior side surfaces.

8. The kit of claim 7 comprising multiple frame units are united to include said primary canvas frame with at least five exterior side surfaces, and comprising multiple frame units united to include comprise a regular supplementary frame dimensioned to form a close fit relationship with said primary frame such that the combination of said primary frame and said supplementary frame form a regular combined frame.

9. The kit of claim 6 comprising a combined frame with:

multiple frame units united to include a continuous primary canvas frame with multiple exterior side surfaces;

at least one frame unit, connected to said exterior side surface, forming a central projection positioned within said exterior side surfaces; and multiple frame units, connected to said central projection, forming a canvas aperture positioned within said exterior side surfaces.

10. The kit of claim 9 further comprising a supplementary canvas frame dimensioned to be positioned within said canvas aperture in a close fit relationship.

11. The kit of claim 1 comprising multiple frame units united to include an irregular primary canvas frame with at least five exterior side surfaces.

12. The kit of claim 11 comprising multiple frame units are united to include said primary canvas frame with at least five exterior side surfaces, and comprising multiple frame units united to include comprise a regular supplementary frame dimensioned to form a close fit relationship with said primary frame such that the combination of said primary frame and said supplementary frame form a regular combined frame.

13. The kit of claim 1 comprising a combined frame with:

multiple frame units united to include a continuous primary canvas frame with multiple exterior side surfaces;

at least one frame unit, connected to said exterior side surface, forming a central projection positioned within said exterior side surfaces; and multiple frame units, connected to said central projection, forming a canvas aperture positioned within said exterior side surfaces.

14. The kit of claim 13 further comprising a supplementary canvas frame dimensioned to be positioned within said canvas aperture in a close fit relationship.

15. A canvas frame comprising:

an irregular primary canvas frame with a continuous canvas periphery having at least five exterior side surfaces forming a canvas aperture;

a supplementary canvas frame with a continuous canvas periphery dimensioned to form a close fit relationship with said canvas aperture to form a regular combined frame; and a flexible primary drawing surface, substantially identical in shape to said primary canvas frame and having surface excess dimensioned to wrap about said primary canvas frame canvas periphery, wherein said surface excess includes at least two contiguous excess buttresses, corresponding to said primary canvas aperture, dimensioned to be overlapping and present a continuous drawing surface through said primary canvas frame upon wrapping said excess about said primary canvas periphery.

16. The canvas frame of claim 15 further comprising a flexible supplementary drawing surface, substantially identical in shape to said supplemental canvas frame.

17. A canvas frame comprising:

a primary canvas frame with a canvas periphery having exterior side surfaces;

a central frame projection, connected to said exterior side surface, positioned within said exterior side surfaces;

a central canvas support, connected to said central frame projection, forming a canvas aperture positioned within said exterior side surfaces; and a flexible primary drawing surface, substantially identical in shape to said primary canvas frame and having surface excess dimensioned to wrap about said primary canvas frame canvas periphery and said central canvas support, wherein said surface excess includes at least two contiguous excess buttresses, corresponding to said canvas aperture, dimensioned to be overlapping and present a continuous drawing surface through said primary canvas frame upon wrapping said excess about said canvas aperture.

18. The canvas frame of claim 17 further comprising a supplementary canvas frame dimensioned to be positioned within said canvas aperture in a close fit relationship.

19. The canvas frame of claim 18 further comprising a flexible supplementary drawing surface, substantially identical in shape to said supplemental canvas frame.

* * * * *